US006744305B2

(12) United States Patent
Oikawa et al.

(10) Patent No.: US 6,744,305 B2
(45) Date of Patent: Jun. 1, 2004

(54) POWER SUPPLY CIRCUIT HAVING VALUE OF OUTPUT VOLTAGE ADJUSTED

(75) Inventors: Kohei Oikawa, Kamakura (JP); Shinichiro Shiratake, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 2 days.

(21) Appl. No.: 10/233,529

(22) Filed: Sep. 4, 2002

(65) Prior Publication Data

US 2003/0042971 A1 Mar. 6, 2003

(30) Foreign Application Priority Data

Sep. 4, 2001 (JP) ..... 2001-267678

(51) Int. Cl.[7] ..... G05F 1/46; G05F 3/16

(52) U.S. Cl. ..... 327/541; 327/543; 323/313; 323/315

(58) Field of Search ..... 327/540, 541, 327/543; 323/313, 315; 315/224

(56) References Cited

U.S. PATENT DOCUMENTS 5,808,458 A * 9/1998 Fujisawa et al. ..... 323/315
5,929,696 A 7/1999 Lim et al. ..... 327/540
6,061,289 A 5/2000 Itoh et al. ..... 365/226
6,333,668 B1 12/2001 Takashima ..... 327/538
6,414,537 B1 * 7/2002 Smith ..... 327/540
6,429,729 B2 * 8/2002 Kobayashi et al. ..... 327/540
6,498,469 B2 * 12/2002 Kobayashi

FOREIGN PATENT DOCUMENTS

JP 9-330135 12/1997
JP 2000-49283 2/2000

OTHER PUBLICATIONS

Duane H. Oto, et al., "High–Voltage Regulation and Process Considerations for High–Density 5 V–Only E$^2$PROM'S", IEEE Journal of Solid–State Circuits, vol. SC–18, No. 5, Oct. 1983, pp. 532–538.

* cited by examiner

*Primary Examiner*—Timothy P. Callahan
*Assistant Examiner*—Terry L. Englund
(74) *Attorney, Agent, or Firm*—Oblon, Spivak, McClelland, Maier & Neustadt, P.C.

(57) ABSTRACT

A power supply circuit includes a transistor, a variable resistance circuit, a second resistance, and an operational amplifier. The variable resistance circuit includes a plurality of first resistances. The plurality of first resistances are selected in response to control signals. The selected first resistances are connected in series with the transistor, the unselected first resistances are connected to a ground voltage. The second resistance is connected between the variable resistance circuit and the ground voltage. The operational amplifier compares a voltage of the one end of the variable resistance circuit with a reference voltage and feeds a signal indicating a comparison result back to the gate of the transistor.

31 Claims, 11 Drawing Sheets

POWER SUPPLY CIRCUIT HAVING VALUE OF OUTPUT VOLTAGE ADJUSTED

CROSS-REFERENCE TO RELATED APPLICATIONS

This application is based upon and claims the benefit of priority from the prior Japanese Patent Application No. 2001-267678, filed Sep. 4, 2001, the entire contents of which are incorporated herein by reference.

BACKGROUND OF THE INVENTION

1. Field of the Invention

The present invention relates to a power supply circuit in which value of output voltage is adjusted in response to control signals, particularly to a power supply circuit which preferably includes a semiconductor integrated circuit.

2. Description of the Related Art

For a power supply circuit included in a semiconductor integrated circuit, particularly in a semiconductor memory device, a set voltage is diversified. Particularly in the power supply circuit for use in a dynamic memory or ferroelectric memory, it is necessary to output voltage which has various values between an external power supply voltage and ground voltage. Additionally, for the voltage to be outputted from the power supply circuit, an optimum set value sometimes differs with characteristics of a processed memory cell. Therefore, the value of the output voltage of the power supply circuit is adjusted in an operation test after the processing.

As a conventional power supply circuit whose output voltage can be adjusted, for example, a circuit shown in FIG. 3 of U.S. Pat. Ser. No. 6,061,289 is known. This power supply circuit is constituted of a ladder circuit including a plurality of resistances, and a two-systems feedback circuit using an operational amplifier.

By characteristics of the feedback circuit using the operational amplifier, the power supply circuit is controlled so that a voltage in a non-reverse input terminal of one operational amplifier OPA is equal to a reference voltage VR supplied to a reverse input terminal and the voltage of the non-reverse input terminal of the other operational amplifier OPB is also equal to the reference voltage VR supplied to the reverse input terminal. Moreover, by the characteristics of the ladder circuit, a total of a first current flowing through a node of a ground voltage VSS from a first node X and a second current flowing through the node of the ground voltage VSS from a second node Y indicates a constant value regardless of set states of control signals A1 to A5.

Moreover, a distribution of first and second currents is changed based on the control signals A1 to A5, thereby the value of a current flowing through a resistance RL connected between the node of the output voltage Vout and the non-reverse input terminal of one operational amplifier OPA is changed, and the value of the output voltage Vout is adjusted.

For example, when the control signals are of 5 bits, the current distribution can be changed in $2^5$=32 stages, and 32 voltages can be set as the output voltages Vout.

However, the conventional power supply circuit uses many resistances, and therefore there is a problem that a chip area increases.

Moreover, since two feedback circuits are used, the power supply circuit is weak at a dispersion in manufacturing a device, and there is a problem in stability of a circuit operation.

As described above, many resistances are used in the conventional power supply circuit, and therefore there is a problem that chip and circuit areas increase. Moreover, since a plurality of feedback circuits are used, the power supply circuit is weak at the dispersion in manufacturing the device, and there is a problem in the stability of the circuit operation.

Therefore, there has been a demand for a power supply circuit in which a chip area does not increase and a steady circuit operation can be achieved.

BRIEF SUMMARY OF THE INVENTION

According to a first aspect of the present invention, there is provided a power supply circuit comprises: a transistor which includes a current path including one end and the other end, and a gate and in which one end of the current path is connected to a supply node of a first voltage and the other end of the current path is connected to a voltage output node; a variable resistance circuit which includes one end, the other end, and a plurality of first resistances and in which one end is connected to the voltage output node, the plurality of first resistances are selected in response to control signals, the selected first resistances are connected in series between one end and the other end, and unselected first resistances are connected to the supply node of a second voltage so as to change a resistance value between one end and the other end; a second resistance connected between the other end of the variable resistance circuit and the supply node of the second voltage; and a comparison circuit which compares the voltage of the other end of the variable resistance circuit with a reference voltage and feeds a signal indicating a comparison result back to the gate of the transistor. According to a second aspect of the present invention, there is provided a power supply circuit comprises: a first transistor with a first polarity, which includes a first current path including one end and the other end, and a gate and in which one end of the first current path is connected to a supply node of a first voltage; a second transistor with a second polarity, which includes a second current path including one end and the other end, and a gate and in which one end of the second current path and the gate are connected to the other end of the first current path; a variable resistance circuit which includes one end, the other end, and a plurality of first resistances and in which one end is connected to the other end of the second current path, the plurality of first resistances are selected in response to control signals, the selected first resistances are connected in series between one end and the other end, and unselected first resistances are connected to the supply node of a second voltage so as to change a resistance value between one end and the other end in response to the control signals; a second resistance connected between the other end of the variable resistance circuit and the supply node of the second voltage; a comparison circuit which compares the voltage of the other end of the variable resistance circuit with a reference voltage and feeds a signal indicating a comparison result back to the gate of the first transistor; and a third transistor with the second polarity, which includes a third current path and gate, whose gate is connected to the gate of the second transistor and whose current path is connected between the supply node of a third voltage and a voltage output node.

DETAILED DESCRIPTION OF THE INVENTION

Figure 1:
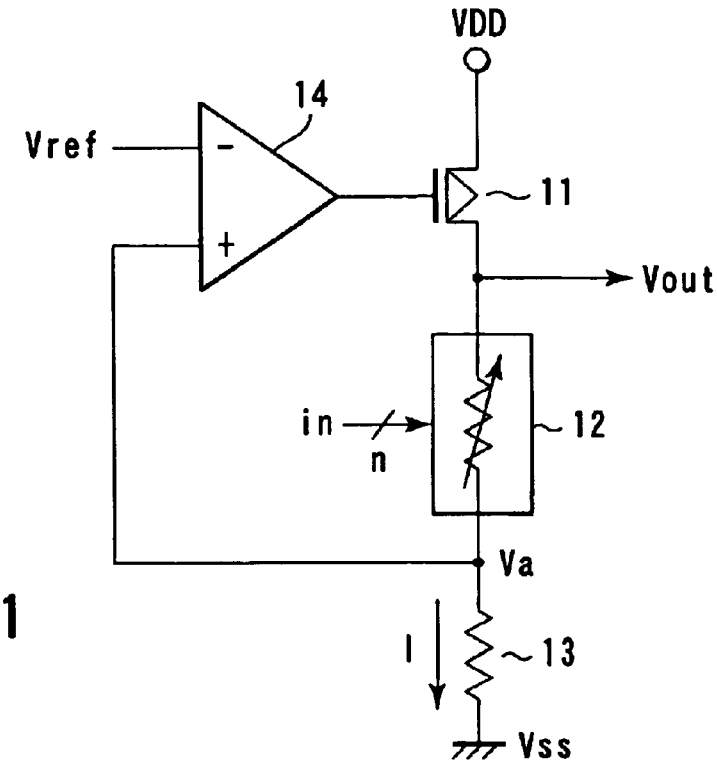
FIG. 1 shows a circuit diagram of a power supply circuit according to a first embodiment.

Embodiments of the present invention will be described hereinafter in detail with reference to the drawing.

<First Embodiment>

FIG. 1 shows a power supply circuit according to a first embodiment.

A source of a PMOS transistor 11 is connected to a supply node of a power supply voltage VDD. A drain of the transistor 11 is connected to an output node of a voltage Vout. One end of a variable resistance circuit 12 whose resistance value changes in response to a control signal in of n bits is connected to the drain of the transistor 11. A resistance 13 is connected between the other end of the variable resistance circuit 12 and the supply node of a ground voltage VSS of 0V. A voltage Va of a series connection node connected to the other end of the variable resistance circuit 12 and resistance 13 is supplied to a non-reverse input terminal (+) of an operational amplifier 14. A reference voltage Vref is supplied to a reverse input terminal (−) of the operational amplifier 14. The operational amplifier 14 compares the voltage Va with the reference voltage Vref, and feeds an output signal back to a gate of the transistor 11.

In the power supply circuit, by the characteristics of the feedback circuit using the operational amplifier, the voltage Va in the non-reverse input terminal (+) of the operational amplifier 14 is controlled so as to be equal to the reference voltage Vref supplied to the reverse input terminal (−). The voltage Va is equal to the reference voltage Vref. Therefore, when the value of the reference voltage Vref is kept to be constant, a current I flowing through the resistance 13 becomes constant. This current I also flows through the variable resistance circuit 12. Here, when a resistance value between opposite ends of the variable resistance circuit 12 is RN, the output voltage Vout is given by (Vref+I×RN). Since the resistance value RN of the variable resistance circuit 12 changes in response to the control signal, the value of the output voltage Vout can be adjusted in response to the control signal.

Figure 2:
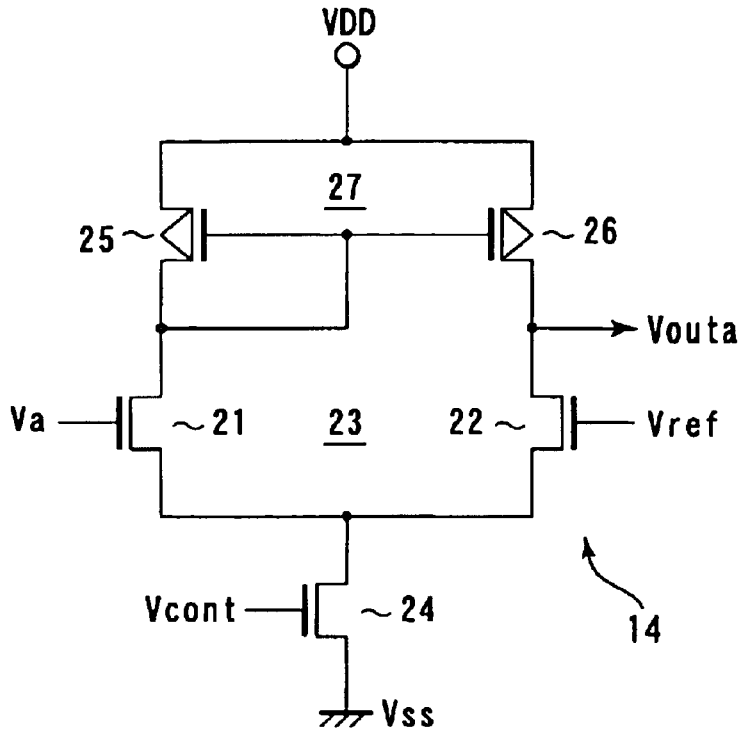
FIG. 2 shows a concrete circuit diagram of an operational amplifier for use in the power supply circuit of FIG. 1.

FIG. 2 shows a concrete circuit constitution example of the operational amplifier 14 in FIG. 1.

The operational amplifier 14 includes a differential pair 23 including a pair of NMOS transistors 21, 22 to whose gates the voltage Va or reference voltage Vref is supplied; an NMOS transistor 24 to whose gate a control voltage Vcont is supplied and which limits the current flowing through the differential pair 23 to a predetermined value; and a current mirror type load circuit 27 which includes a pair of PMOS transistors 25, 26 and acts as a load of the differential pair 23.

The operational amplifier 14 operates as follows.

When the voltage Va rises above the reference voltage Vref, the current flowing through the transistor 21 increases, and a drain potential of the transistor 21 drops. Thereby, the current flowing through the transistor 26 increases, and an output potential Vouta rises.

Conversely, when the voltage Va drops below the reference voltage Vref, the current flowing through the transistor 21 decreases, and the drain potential of the transistor 21 rises. Thereby, the current flowing through the transistor 26 decreases, and the output potential Vouta drops.

The operational amplifier 14 operates as described above. Thereby, in the circuit of FIG. 1, when the voltage Va rises as compared with the reference voltage Vref, the output potential (Vouta) of the operational amplifier 14 rises, and the gate potential of the PMOS transistor 11 rises. Then, the PMOS transistor 11 further operates in a direction in which the transistor is turned off. The current flowing through the resistance 13 decreases, and the voltage Va changes to drop.

Conversely, when the voltage Va drops below the reference voltage Vref, the current flowing through the resistance 13 increases, and the voltage Va changes to rise.

By this operation, as described above, the voltage Va in the non-reverse input terminal of the operational amplifier 14 is controlled so as to be equal to the reference voltage Vref supplied to the reverse input terminal.

Here, for example, when the value of the reference voltage Vref is set to 0.5V, and the resistance value of the resistance 13 is set to 5 MΩ, the value of the current I flowing through the resistance 13 and variable resistance circuit 12 is 0.1 $\mu$A. When the resistance value of the variable resistance circuit 12 is RN, the output voltage Vout is given by (Vref+I×RN), and indicates 0.5+0.1 $\mu$A×RN(V).

Figure 3:
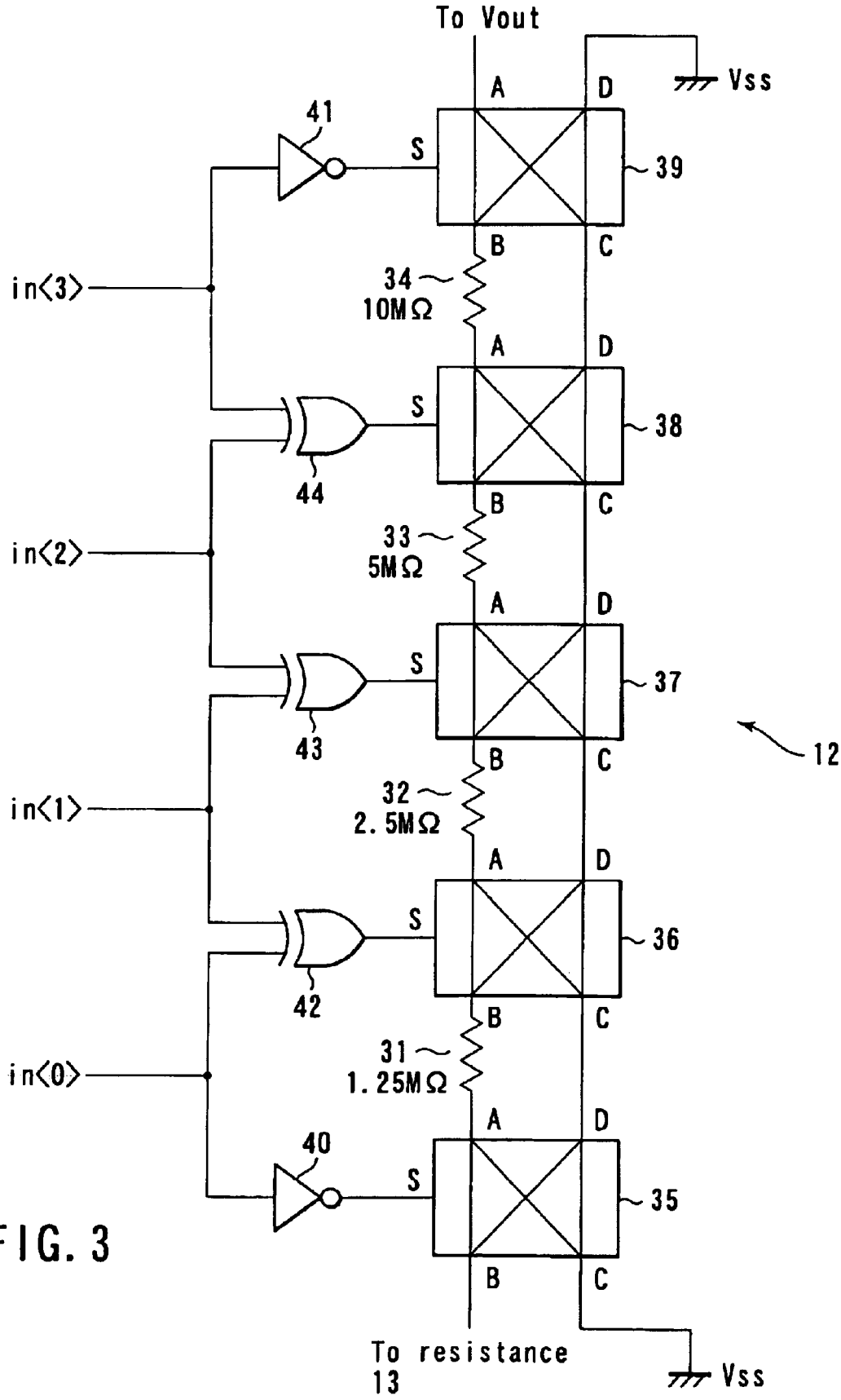
FIG. 3 shows a concrete circuit diagram of a variable resistance circuit for use in the power supply circuit of FIG. 1.

FIG. 3 shows a concrete circuit constitution example of the variable resistance circuit 12 for use in FIG. 1. Here, a case is shown in which the control signal in is of four bits including in<0> to in<3>. The variable resistance circuit 12 includes a plurality of (four in this example) resistances 31 to 34, and a plurality of (five in this example) switch circuits 35 to 39 larger than the total number of the resistances 31 to 34 by one, and a decoder circuit which includes two inverters 40, 41 and three exclusive-OR circuits 42 to 44 and which generates control signals for controlling the operations of the switch circuits 35 to 39 in response to the 4-bits control signals in<0> to in<3>.

Each of the switch circuits 35 to 39 includes four input/output terminals A, B, C, D, and one control input terminal S, respectively. Each switch circuit has a function of changing a connection state among the input/output terminals A, B, C, D in response to the control signal supplied to the input terminal S. Additionally, detailed constitutions of the switch circuits 35 to 39 will be described later.

The input/output terminal B of the switch circuit 35 is connected to the resistance 13. The input/output terminal A of the switch circuit 35 is connected to the input/output terminal B of the switch circuit 36 via the resistance 31, and the input/output terminal D of the switch circuit 35 is directly connected to the input/output terminal C of the switch circuit 36. Similarly, the input/output terminal A of the switch circuit 36 is connected to the input/output terminal B of the switch circuit 37 via the resistance 32, and the input/output terminal D of the switch circuit 36 is directly connected to the input/output terminal C of the switch circuit 37. The input/output terminal A of the switch circuit 37 is connected to the input/output terminal B of the switch circuit 38 via the resistance 33, and the input/output terminal D of the switch circuit 37 is directly connected to the input/output terminal C of the switch circuit 38. The input/output terminal A of the switch circuit 38 is connected to the input/output terminal B of the switch circuit 39 via the resistance 34, and the input/output terminal D of the switch circuit 38 is directly connected to the input/output terminal C of the switch circuit 39. Moreover, the input/output terminal C of the switch circuit 35 and the input/output terminal D of the switch circuit 39 are both connected to the supply node of the ground voltage VSS of 0V.

The decoder circuit generates the control signals to be inputted into the respective control input terminals S of the switch circuits 35 to 39 from the 4-bits control signals in<0> to in<3>.

The inverter 40 generates the control signal to be inputted into the control input terminal S of the switch circuit 35 from the control signal in<0> of a least significant bit among the 4-bits control signals in<0> to in<3>.

The exclusive-OR circuit 42 generates the control signal to be inputted into the control input terminal S of the switch circuit 36 from the control signal in<0> of the least significant bit and the control signal in<1> higher than in<0> by one bit among the 4-bits control signals in<0> to in<3>.

The exclusive-OR circuit 43 generates the control signal to be inputted into the control input terminal S of the switch circuit 37 from the control signal in<1> and one bit higher control signal in<2> among the 4-bits control signals in<0> to in<3>.

The exclusive-OR circuit 44 generates the control signal to be inputted into the control input terminal S of the switch circuit 38 from the control signal in<2> and one bit higher control signal in<3> among the 4-bits control signals in<0> to in<3>.

The inverter 41 generates the control signal to be inputted into the control input terminal S of the switch circuit 39 from the control signal in<3> of a most significant bit among the 4-bits control signals in<0> to in<3>.

Figure 4:
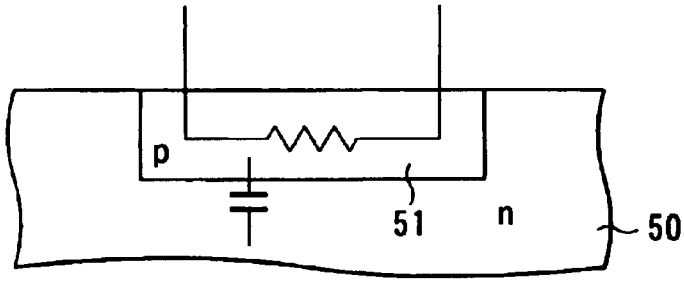
FIG. 4 shows a sectional view showing a device structure of a resistance for use in the power supply circuit of FIG. 1.

FIG. 4 shows a device sectional structure of each of the resistance 13 in FIG. 1 and four resistances 31 to 34 disposed in the variable resistance circuit 12. Each of these resistances is constituted of a diffusion layer 51 formed, for example, by diffusing p-type impurities in a surface region of an n-type semiconductor layer (substrate or well region) 50. Moreover, a diffusion amount of impurities and a length of the diffusion layer 51 are set so that a sum of resistance values of four resistances 31 to 34 is at least 1 MΩ or more.

Figure 5A:
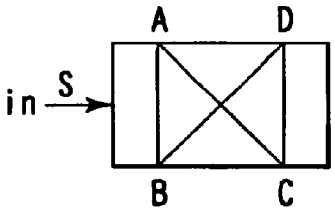
FIGS. 5A to 5C are diagrams showing an inner connection state of a switch circuit for use in the variable resistance circuit of FIG. 3.
Figure 5B:
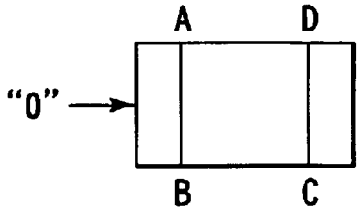
Figure 5C:
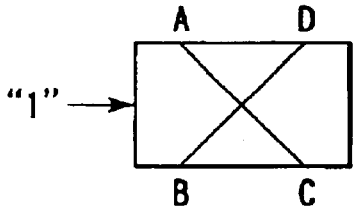

FIG. 5A shows one switch circuit in FIG. 3. When the control signal in supplied to the control input terminal S of the switch circuit is "0", each switch circuit is controlled so as to short-circuit between the input/output terminals A and B, and C and D as shown in FIG. 5B. On the other hand, when the control signal in supplied to the control input terminal S of the switch circuit is "1", each switch circuit is controlled so as to short-circuit between the input/output terminals A and C, and B and D as shown in FIG. 5C.

Figure 6:
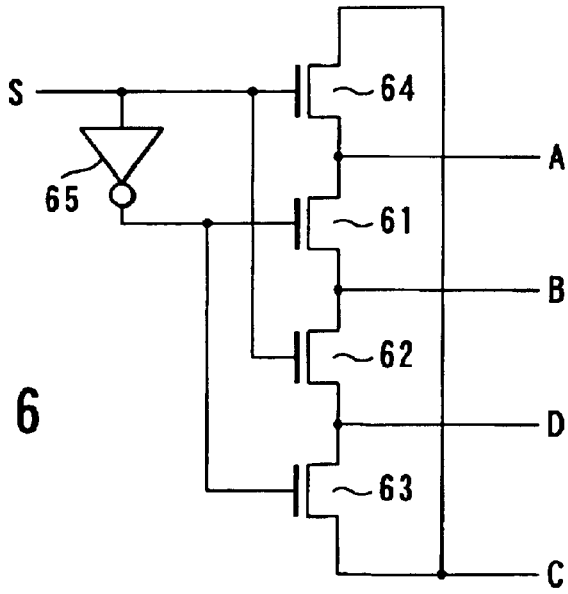
FIG. 6 shows a circuit diagram showing one example of a concrete constitution of the switch circuit for use in the variable resistance circuit of FIG. 3.

One example of a concrete constitution of the switch circuit having such function is shown in FIG. 6.

The switch circuit includes four NMOS transistors 61 to 64 and an inverter 65. A current path between a source and a drain of the NMOS transistor 61 is connected between the input/output terminals A and B. A current path between a source and a drain of the NMOS transistor 62 is connected between the input/output terminals B and D. A current path between a source and a drain of the NMOS transistor 63 is connected between the input/output terminals C and D. A current path between a source and a drain of the NMOS transistor 64 is connected between the input/output terminals A and C. The gates of the transistors 62 and 64 are connected to the control input terminal S. The gates of the transistors 61 and 63 are connected to an output of the inverter 65 which reverses the signal of the control input terminal S.

In the constitution shown in FIG. 6, when the control signal supplied to the control input terminal S is at "0" level, the output of the inverter 65 is "1", and the transistors 61 and 63 are turned on. The other transistors 62 and 64 are turned off. Therefore, in this case, the input/output terminals A and B are connected to each other via the transistor 61 in an on state, and the input/output terminals C and D are connected to each other via the transistor 63 in the on state. This connection state corresponds to the state shown in FIG. 5B.

When the control signal supplied to the control input terminal S is at "1" level, the transistors 62 and 64 are turned on. The output of the inverter 65 is "0", and the other transistors 61 and 63 are turned off. Therefore, in this case, the input/output terminals A and C are connected to each other via the transistor 64 in the on state, and the input/output terminals B and D are connected to each other via the transistor 62 in the on state. This connection state corresponds to the state shown in FIG. 5C.

Here, the resistance values of four resistances 31 to 34 provided in the variable resistance circuit 12 shown in FIG. 3 are different from one another. For example, the resistance 31 is set to 1.25 MΩ, the resistance 32 is set to 2.5 MΩ, the resistance 33 is set to 5 MΩ, and the resistance 34 is set to 10 MΩ. That is, assuming that the resistance value of the resistance 31 is a reference value, the resistance value of the resistance 32 is set to be double the resistance value of the resistance 31, the resistance value of the resistance 33 is set to be four times the resistance value of the resistance 31, and the resistance value of the resistance 34 is set to be eight times the resistance value of the resistance 31. When the resistance value of the resistance 31 is the reference value, the resistance values of the resistances 32 to 34 are $2^i$ (i=1, 2, 3) times the reference value.

Furthermore, among four resistances 31 to 34 disposed in the variable resistance circuit 12, the resistance 31 having a smallest resistance value is provided in a position closest to the resistance 13 in FIG. 1, that is, closest to the supply node of the ground voltage VSS. The resistances 32 to 34 are provided in order from a large resistance value apart from the supply node of the ground voltage VSS and toward the node of the output voltage Vout.

In the variable resistance circuit 12 shown in FIG. 3, the operations of five switch circuits 35 to 39 are controlled in response to the 4-bits control signals in<0> to in<3>, thereby four resistances 31 to 34 are selected, and the selected resistances are connected in series between the node of the output voltage Vout and resistance 13. Moreover, the unselected resistances are also connected in series, and opposite ends of the series connection are connected to the node of the ground voltage VSS.

Figures 7A, 7B, 7C, 7D, 7E:
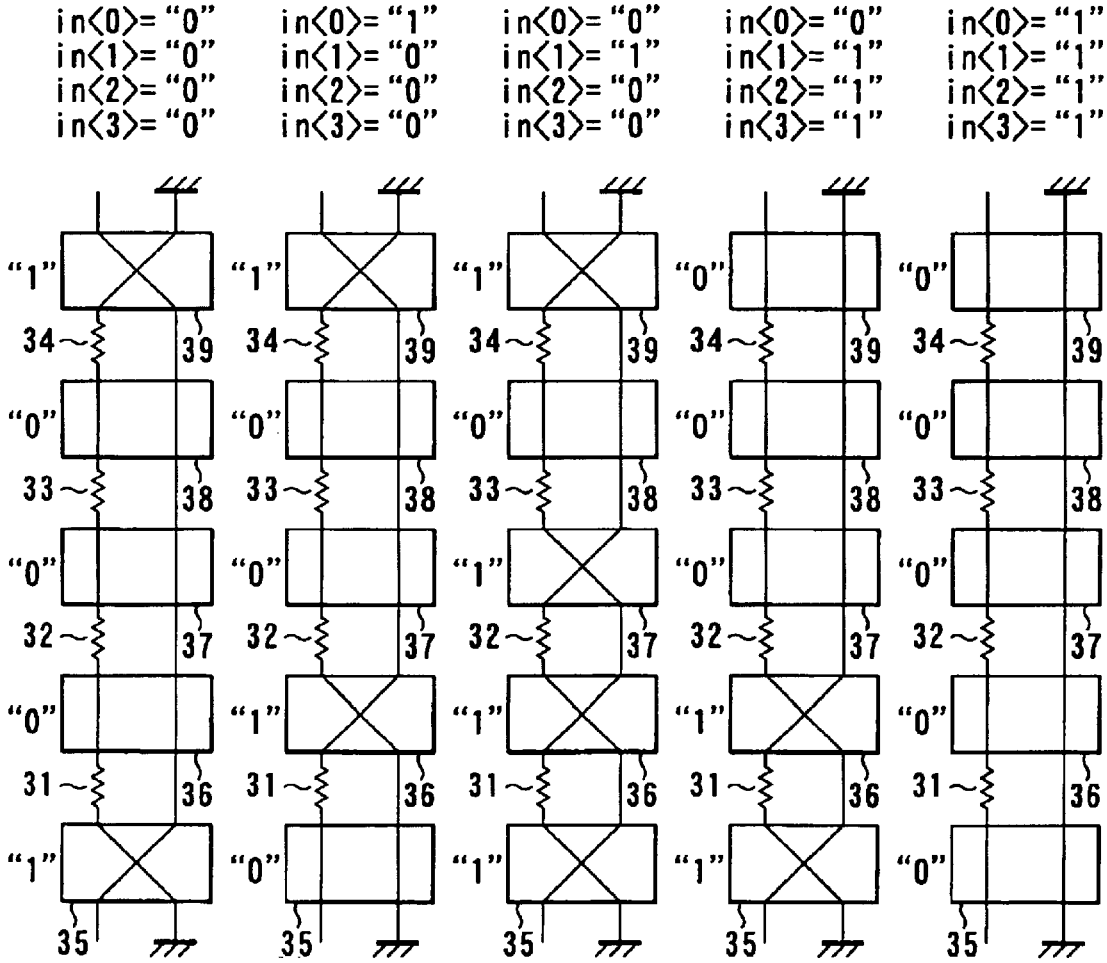
FIGS. 7A to 7E are circuit diagrams showing a change of the inner connection state of the variable resistance circuit of FIG. 3.

For example, when the 4-bits control signals in<0> to in<3> are all at the "0" level as shown in FIG. 7A, the control signals inputted into the control input terminals S of the switch circuits 35 to 39 are both at "1" level, and the control signals inputted into the control input terminals S of the remaining switch circuits are all at the "0" level. In this case, all of the four resistances 31 to 34 are in the unselected state, and these unselected four resistances 31 to 34 are connected in series. One end of the series connection, for example, one end of the resistance 31 is connected to the node of the ground voltage VSS via the switch circuit 35, and the other end of the series connection, for example, one end of the resistance 34 is connected to the node of the ground voltage VSS via the switch circuit 39. Therefore, in this case, the resistance value between the node of Vout and the resistance 13 is substantially 0.

As shown in FIG. 7B, when only in<0> is at the "1" level and the remaining in<1> to in<3> are all at the "0" level among the 4-bits control signals in<0> to in<3>, the control signals inputted into the control input terminals S of the switch circuits 36 and 39 are both at the "1" level, and the control signals inputted into the control input terminals S of the remaining switch circuits are all at the "0" level. In this case, only the resistance 31 is selected, and the selected resistance 31 is connected between the node of the output voltage Vout and the resistance 13. On the other hand, the unselected resistances 32 to 34 are connected in series. One end of the series connection, for example, one end of the resistance 32 is connected to the node of the ground voltage VSS via the switch circuits 36 and 35, and the other end of the series connection, for example, one end of the resistance 34 is connected to the node of the ground voltage VSS via the switch circuit 39. Therefore, in this case, the resistance value between the node of Vout and the resistance 13 is 1.25 MΩ of the resistance 31.

As shown in FIG. 7C, when only in<1> is at the "1" level and the remaining are all at the "0" level among the 4-bits control signals in<0> to in<3>, the control signals inputted into the control input terminals S of the switch circuits 35, 36, 37, and 39 are at the "1" level, and the control signal inputted into the control input terminal S of the remaining switch circuit 38 is at the "0" level. In this case, only the resistance 32 is selected, and the selected resistance 32 is connected between the node of the output voltage Vout and the resistance 13. On the other hand, the unselected resistances 31, 33, 34 are connected in series. One end of the series connection, for example, one end of the resistance 31 is connected to the node of the ground voltage VSS via the switch circuit 35, and the other end of the series connection, for example, one end of the resistance 34 is connected to the node of the ground voltage VSS via the switch circuit 39. Therefore, in this case, the resistance value between the node of Vout and the resistance 13 is 2.5 MΩ of the resistance 32.

Moreover, FIG. 7D similarly shows connection states of the respective resistances in a case in which only in<0> is at the "0" level and the remaining are all at the "1" level among the 4-bits control signals in<0> to in<3>, and FIG. 7E shows the connection states of the respective resistances in a case in which all the 4-bits control signals in<0> to in<3> are at the "1" level. The resistance value between the node of Vout and the resistance 13 in FIG. 7D is 17.5 MΩ as a series resistance value of the resistances 32, 33, 34, and the resistance value between the node of Vout and the resistance 13 in FIG. 7E is 18.75 MΩ as a series resistance value of the resistances 31, 32, 33, 34.

As described above, in the variable resistance circuit 12 shown in FIG. 3, the resistance values of the opposite ends change in response to the 4-bits control signals in<0> to in<3>, and a value RN is as follows.

RN=1.25 MΩ×d (additionally, d is an integer in a range of 0 to 15)

The above d is a value in a case in which in<0> is the least significant bit and in<3> is a binary number of the most significant bit among the 4-bits control signals in<0> to in<3>. For example, when (in<3>, in<2>, in<1>, in<0>) is ("0", "0", "0", "0"), d=0, and RN=0 Ω. Moreover, for example, when (in<3>, in<2>, in<1>, in<0>) is ("0", "1", "1", "1"), d=7, and RN=1.25 MΩ×7=8.25 MΩ. Therefore, the circuit of FIG. 1 outputs a voltage (0.5+0.125×d) (V) as Vout. That is, Vout can be adjusted by a 0.125V step in a range of 0.5V to 2.375V.

Here, since four resistances are used in the variable resistance circuit 12 shown in FIG. 3, five resistances are disposed in the power supply circuit of FIG. 1. On the other hand, in the conventional circuit, the control signal is of five bits. However, when the control signal is of four bits similarly as the above-described embodiment, nine resistances are necessary even in a ladder circuit.

As described above, in the power supply circuit of the first embodiment, the number of resistances for use can be reduced as compared with the conventional circuit. In general, a high resistance constituted by the resistance formed of a diffusion layer as shown in FIG. 4 occupies a large area in the chip as compared with the transistor. Therefore, when the number of resistances decreases, the chip area of the whole power supply circuit can be reduced.

Moreover, only one feedback circuit including the operational amplifier is provided in the power supply circuit of the first embodiment. Therefore, the power supply circuit becomes strong at the dispersion in manufacturing the device, and the stability of the circuit operation can be achieved.

Furthermore, since the constitution shown in FIG. 3 is used as the variable resistance circuit 12, the response of the feedback circuit is effectively enhanced. That is, a high resistance is used in the variable resistance circuit 12, and this high resistance has a relatively large parasitic capacity as described later. In the variable resistance circuit 12 shown in FIG. 3, only the selected resistance is connected between the node of Vout and the resistance 13, and the unselected resistance is connected to the node of the ground voltage VSS. That is, since an extra resistance is separated and grounded, an extra parasitic capacity component can be cut off, and the response of the feedback circuit is enhanced.

Additionally, in the above described embodiment, the case has been described in which four resistances 31 to 34 are provided in the variable resistance circuit 12 and selected based on the 4-bits control signals in<0> to in<3>. However, four or more or three or less resistances may be provided in the variable resistance circuit 12. When four or more resistances are provided, the bit number of the control signal is accordingly increased, and the constitution of the variable resistance circuit 12 shown in FIG. 3 also needs to be changed. In short, a plurality of resistances are connected to the switch circuits so that the resistances and switch circuits are alternately connected, and the resistances selected in response to the control signals are connected in series between the node of the output voltage Vout and one end of the resistance 13. The remaining unselected resistances are connected in series, and the opposite ends of the series connection are both connected to the node of the ground voltage VSS. The variable resistance circuit 12 may be constituted in this manner.

<Second Embodiment>

Figure 8:
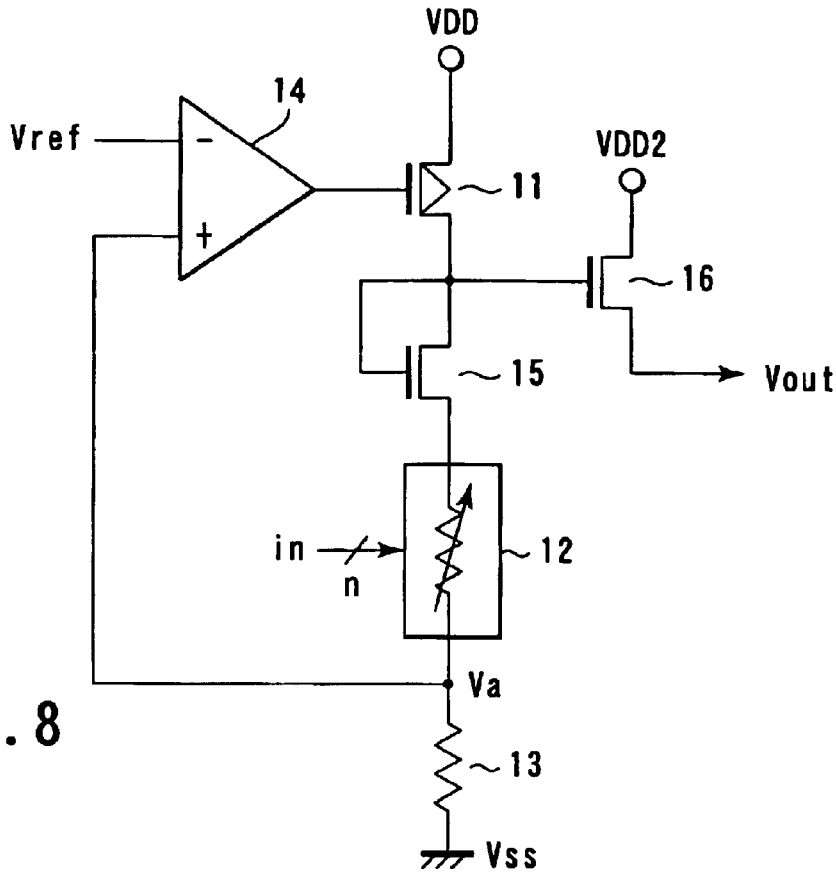
FIG. 8 shows a circuit diagram of the power supply circuit according to a second embodiment.

FIG. 8 shows the power supply circuit according to a second embodiment.

The power supply circuit of the second embodiment is different from that of FIG. 1 in that two NMOS transistors 15, 16 are newly added. Therefore, the part corresponding to FIG. 1 is denoted with the same reference numerals and the description thereof is omitted.

A current path between a drain and a source of the NMOS transistor 15 is inserted between the drain of the PMOS transistor 11 and one end of the variable resistance circuit 12. The gate of the NMOS transistor 15 is connected to the drain of this transistor 15. The gate of the NMOS transistor 16 is connected to the gate of the NMOS transistor 15. A current path between a drain and a source of the NMOS transistor 16 is connected to the supply node of a power supply voltage VDD2 different from the VDD and the node of the voltage Vout.

Here, two newly added transistors 15, 16 constitute a current mirror circuit, and a current proportional to the current flowing through the variable resistance circuit 12 flows through the transistor 16. Moreover, a voltage equal to a voltage generated in one end of the variable resistance circuit 12, that is, a source side of the transistor 15, is outputted from the node of Vout.

In the power supply circuit of the second embodiment, the chip area can be reduced similarly as the circuit of FIG. 1. The effect is obtained that the power supply circuit is strong against the dispersion in manufacturing the device and the circuit operation can be stabilized. Additionally, the following effect is obtained.

That is, in the power supply circuit of the second layer has the parasitic capacity with respect to the semiconductor layer (substrate or well region). Therefore, the high resistance has a time constant of (resistance×parasitic capacitance). A representative value of the parasitic capacitance is, for example, 0.3 pF per 1 MΩ. Therefore, the time constant of the resistance of 5 MΩ is 5 MΩ×1.5 pF=7.5 μs. With 20 MΩ, the time constant is about 120 μs=20 MΩ×6 pF.

Therefore, the time constant of the power supply circuit shown in FIGS. 1 and 8 is generally 100 μs or more. After the turning-on of the power, the output potential is not stabilized until a time of about 100 μs elapses. Additionally, it is known that the output potential is once stabilized and then the output potential is stabilized by amplification characteristics of the feedback circuit even with the time constant of the circuit of 100 μs or more.

However, immediately after the power is turned on, the time constant determined by the resistance value and capacitance is required as the time for defining the output potential, before the potential added to the high resistance obtains a steady state. Therefore, a time of several hundreds of microseconds or more is required.

In many of the semiconductor integrated circuits, a time immediately after the turning-on of the power embodiment, the output voltage Vout is extracted via the NMOS transistor 16 whose drain is connected to the supply node of the power supply voltage VDD2. Therefore, the circuit can be designed so that the potential fluctuation of Vout is reduced against the fluctuation of a load to which Vout is supplied. That is, a channel width of the NMOS transistor 16 is changed in accordance with the load, and thereby the potential fluctuation of Vout can be minimized.

Additionally, the power supply voltage VDD2 may be set to be equal to the power supply voltage VDD.

Moreover, since the resistance for use in the power supply circuit according to the first and second embodiments is a high resistance of 1 MΩ or more, the power consumed in the power supply circuit can be reduced. However, on the other hand, when the power supply voltage is raised, a time required for defining the output voltage Vout lengthens. This respect will be described hereinafter.

As described above, the current I flowing through the resistance 13 is, for example, 0.1 μA and very small, and this realizes a super low current consumption. The high resistance of 1 MΩ or more is used in order to achieve the super low current consumption. In a semiconductor integrated circuit, the resistance formed of a diffusion layer shown in FIG. 4 is used as the high resistance. The diffusion until the operation is possible is defined as a rated value. This rated value is 200 μs, for example, in a synchronous DRAM, and a stabilizing time which is not less than several hundreds of microseconds cannot be taken. One method of preventing this comprises: lowering the resistance value to realize a small time constant. However, the power consumption increases in this method.

Various embodiments for using the high resistance to realize the super low current consumption and defining the output value immediately after turning on the power supply voltage will next be described.

<Third Embodiment>

Figure 9:
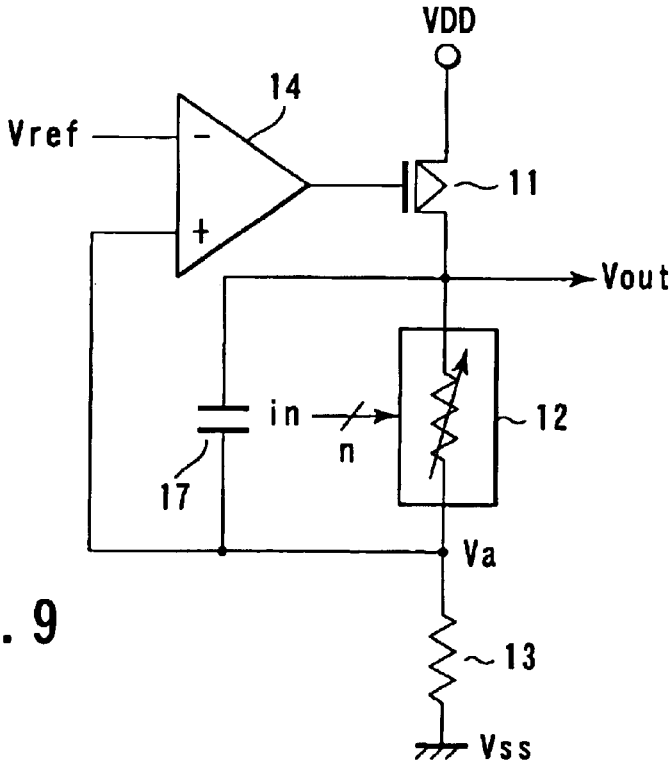
FIG. 9 shows a circuit diagram of the power supply circuit according to a third embodiment.

FIG. 9 shows the power supply circuit according to a third embodiment of the present invention.

The power supply circuit of the third embodiment is different from that of FIG. 1 in that a capacitance 17 is connected between the node of the output voltage Vout and the other end of the variable resistance circuit 12. Other respects are similar to those of FIG. 1. Therefore, the part corresponding to FIG. 1 is denoted with the same reference numerals and the description thereof is omitted.

The capacitance 17 has a function of quickly conducting the potential fluctuation in the node of the output voltage Vout to the node of the voltage Va as the series connection node of the variable resistance circuit 12 and resistance 13 and quickly feeding the potential of the node of the output voltage Vout back to the operational amplifier 14.

Figure 10:
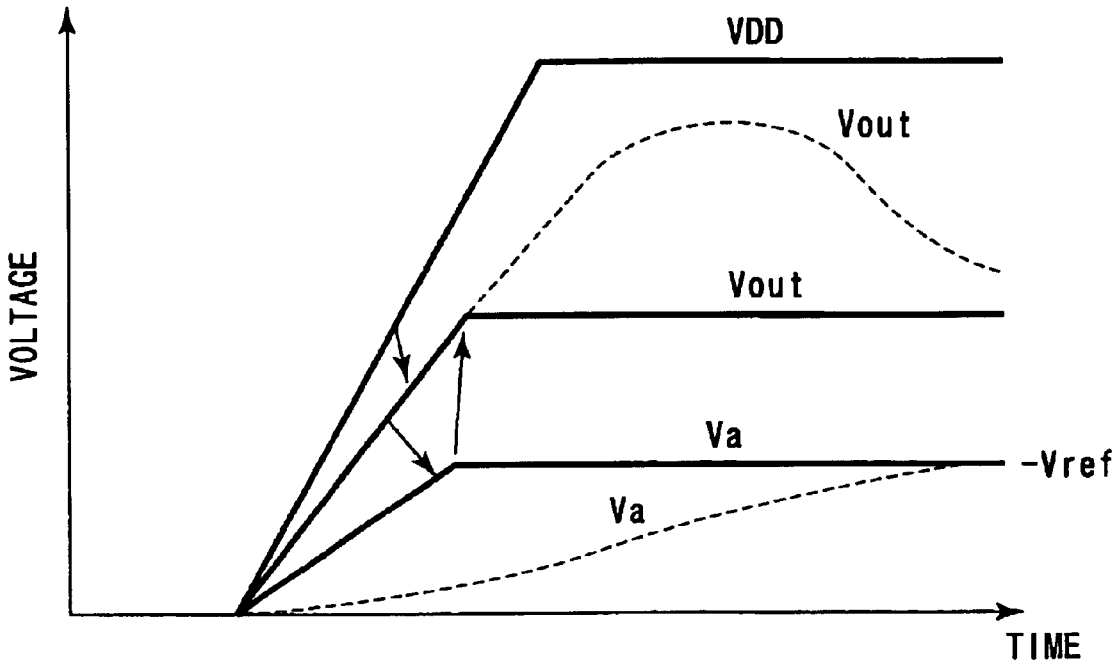
FIG. 10 is a waveform diagram showing a state of a potential change of each node during the turning-on of the power supply circuit of FIG. 9.

FIG. 10 is a waveform diagram showing a state of a potential change in each node of the power supply voltage VDD, output voltage Vout and voltage Va during the turning-on of the power.

An operation of the power supply circuit of FIG. 9 will next be described with reference to FIG. 10.

When the power supply voltage is turned on, the power supply voltage VDD rapidly rises from 0V. Accordingly, the node of the output voltage Vout is charged via the PMOS transistor 11, and the potential of the node of Vout also rises. Here, the nodes of Vout and Va are coupled with the capacitance 17. Therefore, with the potential rise of the node of Vout, the potential of the node of Va also rises. The node of Va is connected to the non-reverse input terminal of the operational amplifier 14. Therefore, when the potential of the node of Va becomes high above the reference potential Vref, the output of the operational amplifier 14 reaches an "H" level, and the PMOS transistor 11 is turned off. This stops the rise of the potential of the node of Vout.

Thereafter, as described above, by the action of the feedback circuit, the potential of the node of Vout drops, and thereby the potential of Va drops. When the PMOS transistor 11 is turned on, the potential of the node of Vout rises. Conversely, the potential of the node of Vout rises, thereby the potential of Va also rises, the PMOS transistor 11 is turned off, and thereby the potential of the node of Vout stops rising, so that the potential of the node of Vout is controlled at a constant value.

Additionally, as shown by a broken line in FIG. 10, the potentials of the nodes of Vout and Va change, when the capacitance 17 is not provided. When the capacitance 17 is not provided, the potential of the node of Vout rapidly rises immediately after the turning-on of the power supply voltage. On the other hand, the potential of the node of Va moderately rises. A reason why this phenomenon occurs is that the resistance 13 is very high and resistance 13 has large parasitic capacitance. When the node of Va is influenced by the potential of the node of Vout, a delay is generated by the time constant represented by a product of the resistance value and parasitic capacitance of the resistance 13. Therefore, the potential Va does not easily reach the reference voltage Vref, Vout excessively rises above a desired value, and an overshoot occurs.

In the power supply circuit of the third embodiment, since the nodes of Vout and Va are coupled with the capacitance 17, the operation can be stabilized immediately after the turning-on of the power supply voltage, and the output voltage Vout can quickly be defined immediately after the turning-on of the power supply voltage.

Figure 12A:
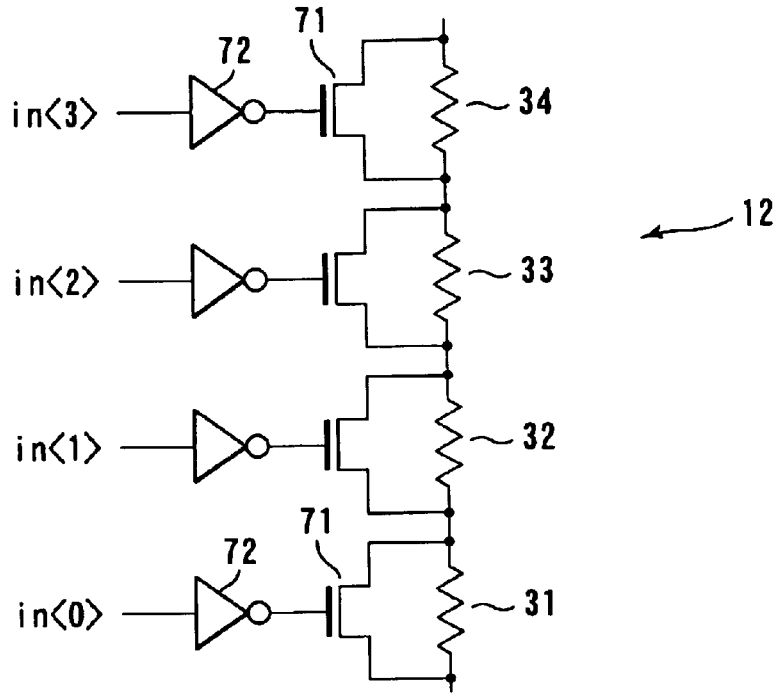
FIGS. 12A to 12C are circuit diagrams showing other constitutions of a variable resistance circuit for use in the power supply circuit of FIGS. 1, 8 and 9.
Figure 12B:
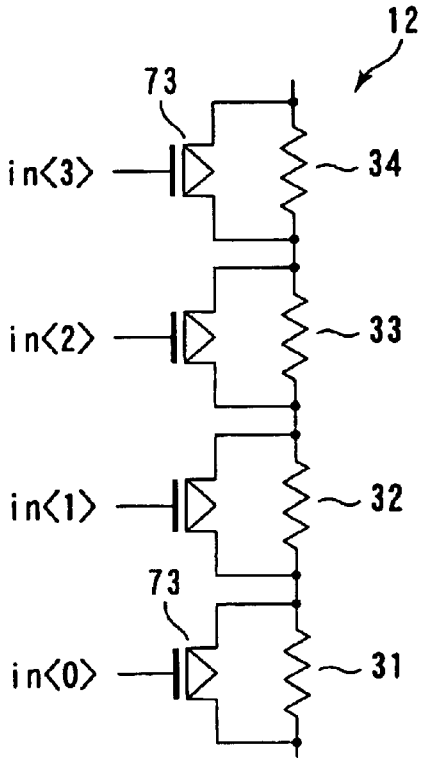
Figure 12C:
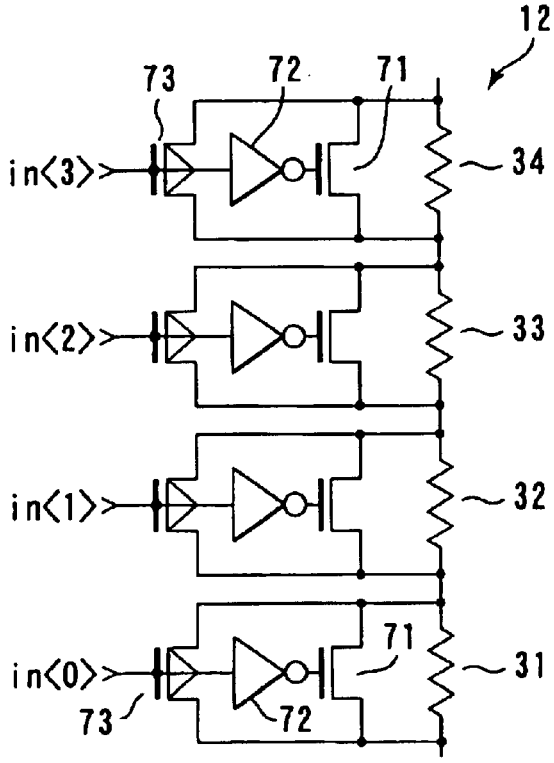

Additionally, as the variable resistance circuit 12 in the power supply circuit of FIG. 9, in addition to the circuit constituted as shown in FIG. 3, for example, constitutions shown in FIGS. 12A to 12C can be used. Similarly, as the variable resistance circuit 12 in the power supply circuit of FIGS. 1 and 8, in addition to the circuit constituted as shown in FIG. 3, for example, constitutions shown in FIGS. 12A to 12C can be used.

The variable resistance circuit 12 of FIG. 12A includes four resistances 31 to 34, four NMOS transistors 71 which serve as switches connected in parallel with the respective resistances 31 to 34, and four inverters 72 to which the 4-bits control signals in<0> to in<3> are inputted. The control signals in<0> to in<3> are reversed by the four inverters 72 and inputted into the respective gates of four NMOS transistors 71. The respective resistance values of four resistances 31 to 34 are the same as those in FIG. 3.

In the variable resistance circuit 12 of FIG. 12A, when the 4-bits control signals in<0>to in<3> are all at the "0" level, the outputs of four inverters 72 are all at the "1" level, and all of the four NMOS transistors 71 are turned on. In this case, since the opposite ends of each of four resistances 31 to 34 are short-circuited, the resistance value of the whole variable resistance circuit 12 substantially turns to zero.

Moreover, for example, when only in<0> is at the "1" level, the output of the inverter 72 with the control signal inputted therein indicates the "0" level. Only the NMOS transistor 71 to whose gate the output of the inverter 72 is inputted is turned off. Therefore, in this case, only the resistance 31 is connected between the opposite ends of the variable resistance circuit 12, and the resistance value in the variable resistance circuit 12 becomes equal to the resistance value of the resistance 31.

Furthermore, for example, when in<0> to in<3> are all at the "1" level, all the outputs of four inverters 72 are at the "0" level, and four NMOS transistors 71 are all turned off. Therefore, in this case, the resistances 31 to 34 are connected in series between the opposite ends of the variable resistance circuit 12, and the resistance value in the variable resistance circuit 12 is equal to the series resistance value of the resistances 31 to 34.

In the variable resistance circuit 12 of FIG. 12B, PMOS transistors 73 are used as switches for short-circuiting or releasing the opposite ends of each resistance instead of the NMOS transistors 71 in FIG. 12A. In this case, the respective inverters 72 are unnecessary.

In the variable resistance circuit 12 of FIG. 12C, the NMOS transistors 71 in FIG. 12A and the PMOS transistors 73 in FIG. 12B are combined and used as the switches for short-circuiting the opposite ends of each resistance.

Additionally, also in the respective variable resistance circuits 12 of FIGS. 12A to 12C, the number of resistances is not limited to four, and five or more or three or less resistances may be disposed.

Moreover, the value of the capacitance 17 has not been especially described in the power supply circuit of FIG. 9. The value of the capacitance 17 is selected so that the output voltage is most quickly stabilized immediately after the turning-on of the power supply voltage, using the variable resistance circuit 12 constituted as shown in FIGS. 3 or 12A to 12C and assuming a voltage with a substantially intermediate adjustable value between 0.5V and 2.375V as the output voltage with a desired value. When the value of the capacitance 17 is selected as described above, the output voltage Vout is quickly defined immediately after the turning-on of the power supply voltage without causing any overshoot as shown by a solid line of FIG. 10.

Furthermore, the capacitance 17 is set as described above, and the control signal is set so as to set the output voltage Vout, for example, to 0.5V. Then, the waveform of the output voltage Vout causes the overshoot as shown by the waveform diagram of FIG. 11. Conversely, when the set value of the output voltage Vout is, for example, 2.375V, the PMOS transistor 11 is turned off too quickly. Therefore, the output voltage Vout does not easily reach the set value as shown in the waveform diagram of FIG. 11.

Therefore, a capacitance circuit is used in which the capacitance value changes in accordance with the value of the output voltage Vout, instead of a constant capacitance like the capacitance 17. The nodes of Vout and Va are coupled with a capacitance. Then, the voltage Va can quickly be defined in accordance with the set output voltage Vout.

<Fourth Embodiment>

Figure 13:
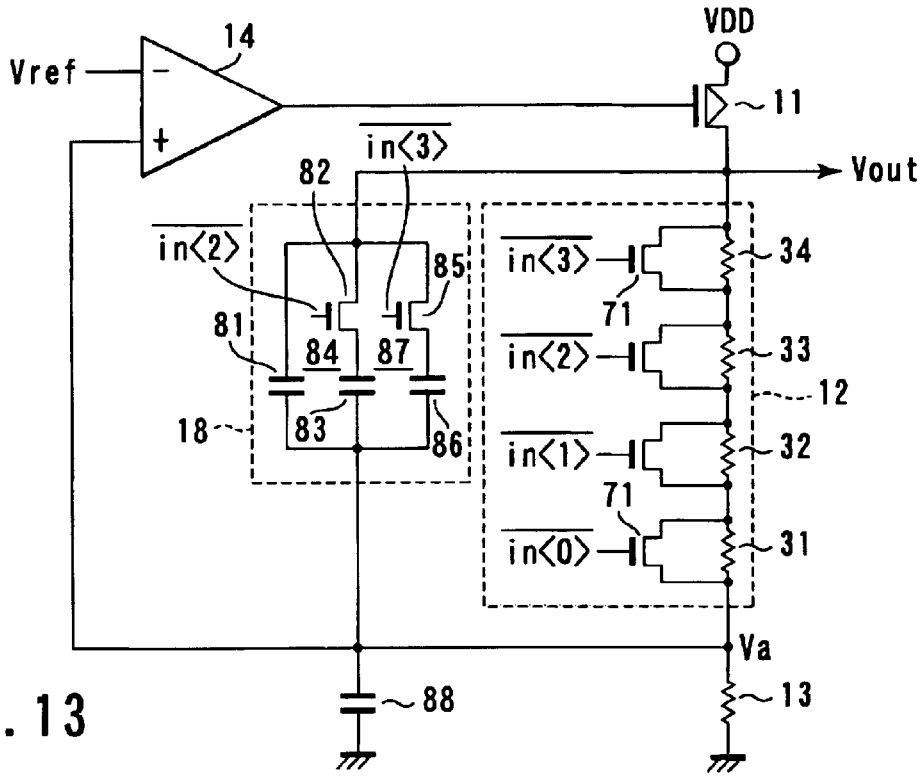
FIG. 13 shows a circuit diagram of the power supply circuit according to a fourth embodiment.

FIG. 13 shows the power supply circuit according to a fourth embodiment of the present invention.

In the power supply circuit of the fourth embodiment, instead of the capacitance 17 with the constant value for use in the power supply circuit of FIG. 9, a capacitance circuit 18 is connected between the nodes of Vout and Va. A capacitance value of the capacitance circuit 18 changes in accordance with the value of the output voltage Vout.

Moreover, in this case, the use of the constitution of FIG. 12A as the variable resistance circuit 12 is shown. However, since the inverters 72 in FIG. 12A are omitted from FIG. 13, the control signals are shown by reverse signals /in<3>, /in<2>, /in<1>, and /in<0> for the sake of convenience.

The capacitance circuit 18 includes a capacitance 81 and two series circuit 84, 87. The capacitance 81 and two series circuit 84, 87 are connected between the node of the output voltage Vout and the other end of the variable resistance circuit 12, respectively. The series circuit 84 is constituted by connecting an NMOS transistor 82 and capacitance 83 in series. The series circuit 87 is constituted by connecting an NMOS transistor 85 and capacitance 86 in series. Moreover, a reverse signal /in<2> of the control signal in<2> is inputted into a gate of the NMOS transistor 82, and a reverse signal /in<3> of the control signal in<3> is inputted into a gate of the NMOS transistor 85.

Additionally, a stabilizing capacitance 88 for stabilizing the voltage Va is connected between the other end of the variable resistance circuit 12 (the node of the voltage Va) and the supply node of the ground voltage VSS.

In the power supply circuit constituted in this manner, it is assumed that the 4-bits control signals in<0> to in<3> are all at the "0" level, the NMOS transistors 71 in the variable resistance circuit 12 are all turned on, and Vout set to a lowest value is outputted. In this case, since the NMOS transistors 82, 85 in the series circuits 84, 87 in the capacitance circuit 18 are turned on, the capacitance value in the capacitance circuit 18 is a parallel capacitance value of three capacitances 81, 83, 86, and is a largest capacitance value which can be indicated by the capacitance circuit 18.

Figure 11:
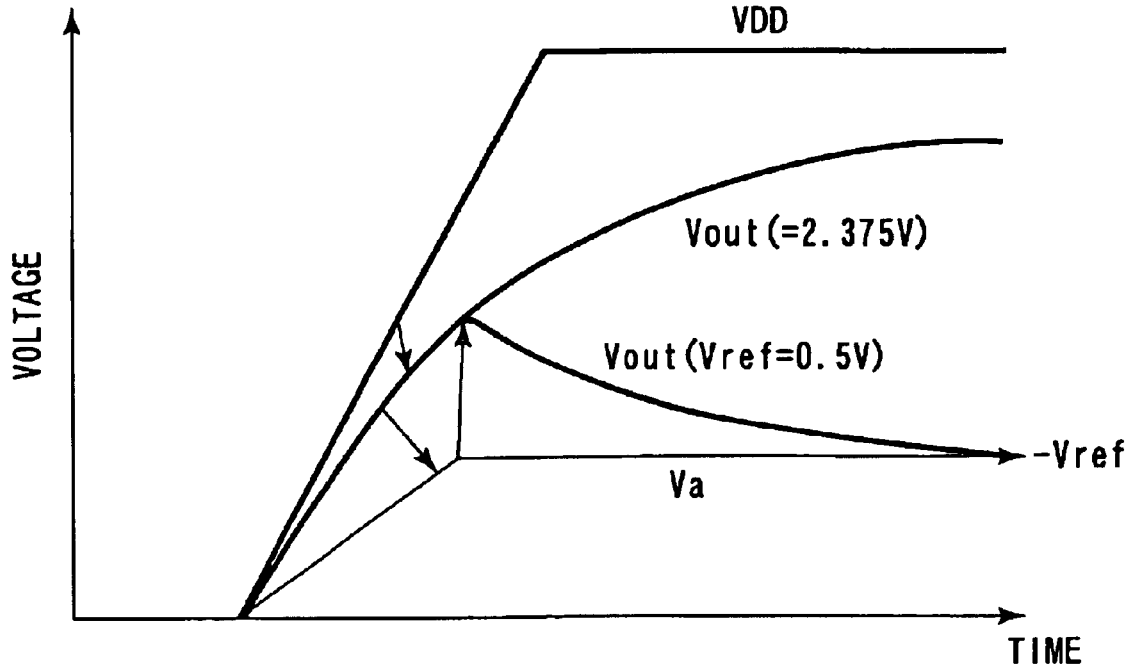
FIG. 11 is a waveform diagram showing the state of the potential change of each node when the power supply circuit of FIG. 9 is turned on and operated on a certain condition.

In this case, when the potential Vout rises immediately after the turning-on of the power supply voltage, the potential Va rapidly rises, and the PMOS transistor 11 is turned off relatively quickly by the output of the operational amplifier 14. Therefore, the charging of the node of Vout via the PMOS transistor 11 stops early, and an extra potential rise is not generated in the node of Vout. That is, a phenomenon in which the overshoot occurs immediately after the turning-on of the power supply voltage as shown in FIG. 11 is eliminated, and the set value of Vout is quickly defined.

It is next assumed that the in<2> and in<3> are at the "1" level among the 4-bits control signals in<0> to in<3>, the resistances 34, 33 having relatively high values in the variable resistance circuit 12 are connected in series between the nodes of Vout and Va, and the relatively high voltage is outputted from the node of Vout. In this case, the NMOS transistors 82, 85 in the series circuits 84, 87 are both turned off, and the capacitance value in the capacitance circuit 18 substantially becomes equal to the value of the capacitance 81. In this case, as compared with the case in which the 4-bits control signals in<0> to in<3> are all at the "0" level, the capacitance value in the capacitance circuit 18 decreases. Therefore, in this case, the degree of the capacitance coupling between the nodes of Vout and Va decreases. Even when the potential Vout rises, the potential Va does not rise very much.

Moreover, after the power supply voltage is turned on, the PMOS transistor 11 is turned off by the output of the operational amplifier 14 relatively late. Since the node of Vout is charged long via the PMOS transistor 11, an initial potential of Vout increases. That is, a phenomenon in which Vout does not easily rise immediately after the turning-on of the power supply voltage as shown in FIG. 11 is eliminated, and Vout is quickly defined at the set value.

Additionally, in the power supply circuit of the fourth embodiment, there are two series circuits in which the NMOS transistors and capacitances are connected in series in the capacitance circuit 18. Therefore, for the output voltage Vout, the value is divided into four stages between highest and lowest values, and accordingly the capacitance value in the capacitance circuit 18 changes. The value of the output voltage Vout is largely influenced by the resistance with the high resistance value among four resistances 31 to 34 provided in the variable resistance circuit 12. Therefore, the two series circuits are provided in the capacitance circuit 18 for the resistance 34 having the highest resistance value and the resistance 33 having the next high resistance value. However, when there is not much influence, only one series circuit may be provided in the capacitance circuit 18 for the resistance 34 having the highest resistance value. Alternatively and conversely, when a higher-precision control is necessary, three or more series circuits may be provided in the capacitance circuit 18.

<Fifth Embodiment>

Figure 14:
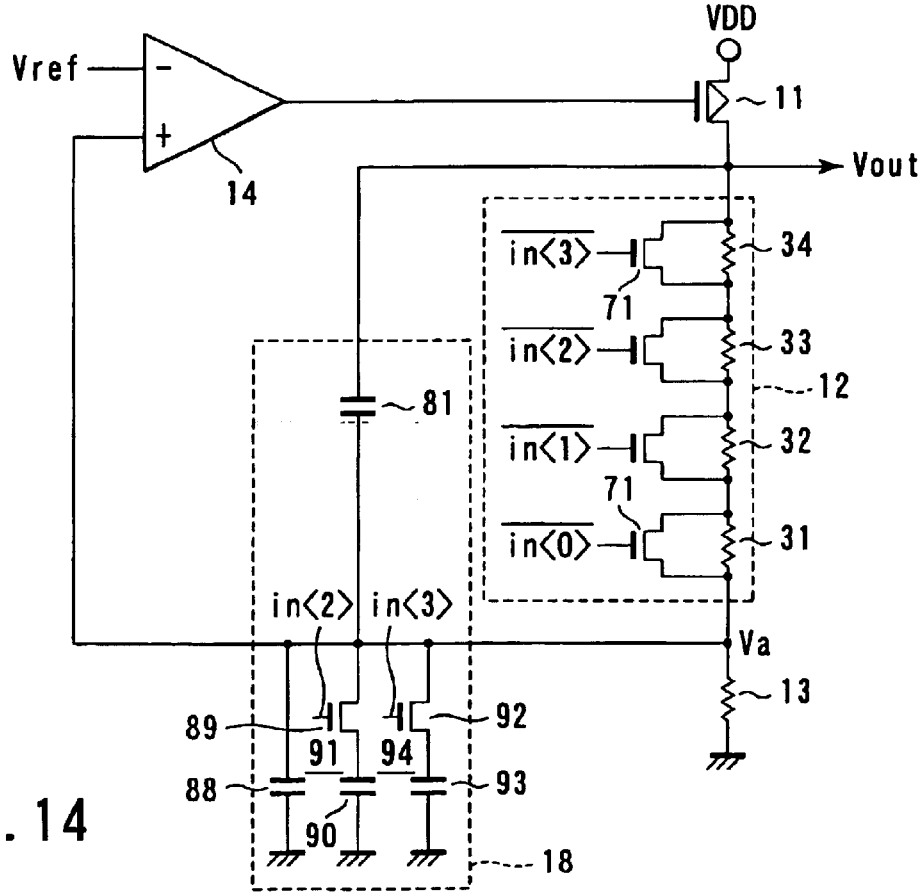
FIG. 14 shows a circuit diagram of the power supply circuit according to a fifth embodiment.

FIG. 14 shows the power supply circuit according to a fifth embodiment of the present invention.

As described in the power supply circuit of FIG. 13, when the set value of the output voltage Vout is high, the capacitance coupling between the nodes of Vout and Va is weakened. When the set value is low, the capacitance coupling is strengthened. Thereby, Vout can be defined at the desired value quickly after the power supply voltage is turned on. In the power supply circuit of FIG. 13, the degree of the capacitance coupling between the nodes of Vout and Va is realized by changing the capacitance value connected between the nodes of Vout and Va.

However, the degree of the capacitance coupling between the nodes of Vout and Va is also determined by a ratio of a stabilizing capacitance connected to the node of Va to the capacitance connected between the nodes of Vout and Va.

Here, in the power supply circuit of FIG. 14, the capacitance circuit 18 is provided, only the fixed capacitance 81 is connected between the nodes of Vout and Va, and the value of the capacitance between the nodes of Va and ground voltage VSS is changed.

The capacitance circuit 18 includes the capacitance 81, a stabilizing capacitance 88, and two series circuit 90, 91. The stabilizing capacitance 88 and two series circuit 91, 94 are connected between the nodes of Va and ground voltage VSS, respectively. The series circuit 91 is constituted by connecting an NMOS transistor 89 and capacitance 90 in series. The series circuit 94 is constituted by connecting an NMOS transistor 92 and capacitance 93 in series. The control signal in<2> is inputted into a gate of the NMOS transistor 89, and the control signal in<3> is inputted into a gate of the NMOS transistor 92.

In the power supply circuit, it is assumed that the 4-bits control signals in<0> to in<3> are all at the "1" level, all the NMOS transistors 71 are turned off in the variable resistance circuit 12, and Vout set to the highest value is outputted. In this case, since the NMOS transistors 89, 92 in the series circuits 91, 94 are turned on, three capacitances 88, 90, 93 are connected in parallel between the nodes of Va and ground voltage VSS, and the capacitance value between the nodes of Va and ground voltage VSS increases.

Therefore, in this case, even when the potential Vout rises, the potential Va does not rise much. Moreover, after the power supply voltage is turned on, the PMOS transistor 11 is turned off by the output of the operational amplifier 14 relatively late. Since the node of Vout is charged long via the PMOS transistor 11, the initial potential of Vout increases. That is, the phenomenon in which Vout does not easily rise immediately after the turning-on of the power supply voltage is eliminated, and Vout is quickly defined at the set value.

When in<2> or in<3> is at the "0" level among the 4-bits control signals in<0> to in<3>, and the relatively low voltage is outputted from the node of Vout, the NMOS transistor 89 or 92 in the series circuit 91, 94 is turned off, and the capacitance value between the nodes of Va and ground voltage VSS is reduced as compared with the above-described case. In this case, the effect of the capacitance coupling by the capacitance 81 connected between the nodes of Vout and Va is strengthened. That is, when the potential of the node of Vout rises immediately after the turning-on of the power supply voltage, the potential Va rapidly rises, and the PMOS transistor 11 is turned off by the output of the operational amplifier 14 relatively quickly. Therefore, the charging of the node of Vout via the PMOS transistor 11 quickly stops, and the extra potential rise is not generated in the node of Vout. That is, the overshoot does not occur immediately after the turning-on of the power supply voltage, and the voltage Vout is quickly defined at the set value.

Additionally, in the power supply circuit of the fifth embodiment, there are two series circuits in which the NMOS transistors and capacitances are connected in series in the capacitance circuit 18. Therefore, for the output voltage Vout, the value is divided into four stages between the highest and lowest values, and accordingly the capacitance value between the nodes of Va and VSS in the capacitance circuit 18 changes. The value of the output voltage Vout is largely influenced by the resistance with the high resistance value among four resistances 31 to 34 provided in the variable resistance circuit 12. Therefore, the two series circuits 91, 94 are provided in the capacitance circuit 18 for the resistance 34 having the highest resistance value and the resistance 33 having the next high resistance value. However, when there is not much influence, only one series circuit may be provided in the capacitance circuit 18 for the resistance 34 having the highest resistance value. Alternatively, when the higher-precision control is necessary, three or more series circuits may be provided.

<Sixth Embodiment>

Figure 15:
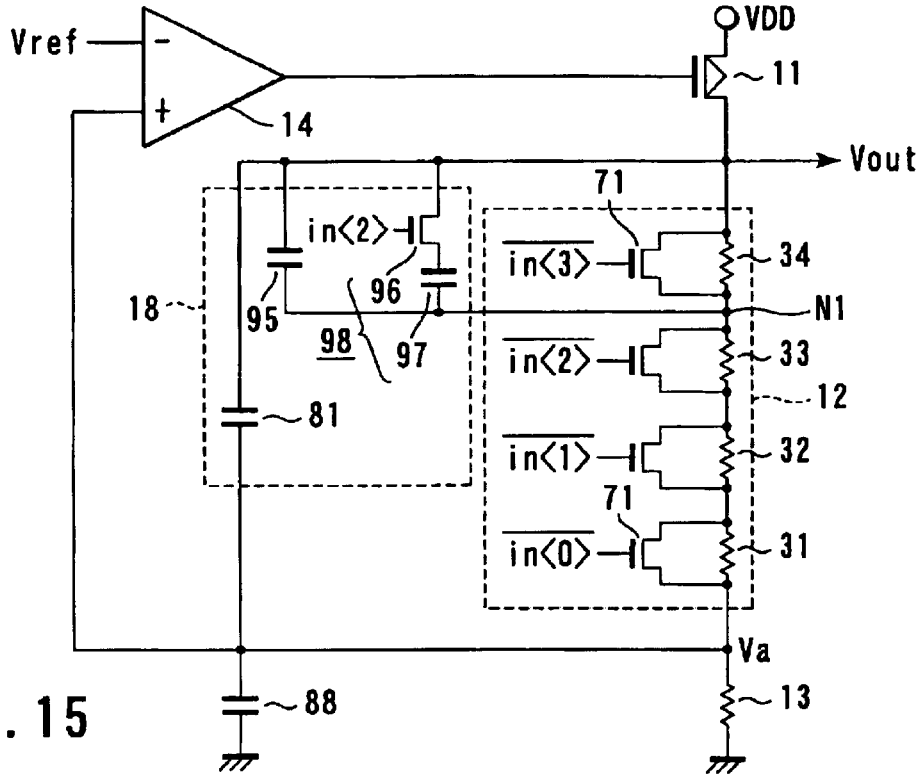
FIG. 15 shows a circuit diagram of the power supply circuit according to a sixth embodiment.

FIG. 15 shows the power supply circuit according to a sixth embodiment of the present invention.

In the power supply circuit of FIG. 9, to quickly define Vout at the desired value after the turning-on of the power supply voltage, the capacitance 17 is connected between the nodes of Vout and Va, and the nodes are coupled with the capacitance 17.

On the other hand, in the power supply circuit of FIG. 15, the capacitance circuit 18 is provided between the nodes of Vout and Va, thereby Vout is defined quickly in accordance with the set output voltage Vout, and the parasitic capacitance existing in the intermediate node of the variable resistance circuit 12 is quickly charged. The effect that Vout is quickly defined at the desired value is enhanced.

That is, the capacitance circuit 18 provided in the power supply circuit includes the capacitance 81, a capacitance 95, and a series circuit 98. The capacitance 81 is connected between the nodes of Vout and Va. The capacitance 95 and the series circuit 98 are connected between the node of Vout and the intermediate node of the variable resistance circuit 12, for example, a series connection node N1 of the resistance 34 with the largest resistance value and the resistance 33 with the next high resistance value in FIG. 15, respectively. The series circuit 98 is constituted by connecting an NMOS transistor 96 and a capacitance 97 in series. Additionally, the control signal in<2> is inputted into a gate of the transistor 96.

The capacitance 95 charges the parasitic capacitance existing in the series connection node N1 of the variable resistance circuit 12 in accordance with the potential Vout.

Additionally, a raising amount of the potential of the series connection node N1 differs depending on whether or not the resistance 34 is selected. Therefore, the series circuit 98 including the NMOS transistor 96 and capacitance 97 is provided. The NMOS transistor 96 is turned on, when the resistance 34 is selected. Moreover, the parasitic capacitance existing in the series connection node N1 is charged via the capacitance 96.

In the power supply circuit of the sixth embodiment, immediately after the power supply voltage is turned on, the potential Vout rises. Then, the potential Va is influenced by a path via the capacitance 81, the potential Va rapidly rises, and the PMOS transistor 11 is turned off by the output of the operational amplifier 14 relatively quickly. Therefore, the charging of the node of Vout via the PMOS transistor 11 quickly stops, the extra potential rise of the node of Vout is not caused, and Vout is quickly defined at the set value.

Moreover, the parasitic capacitance existing in the series connection node N1 is simultaneously charged only by the capacitance 95 or a parallel path by the capacitances 95 and 96, and a speed at which Vout is defined at the set value increases.

Additionally, in the power supply circuits of the respective embodiments of FIGS. 13 to 15, the use of the constitution of FIG. 12A as the variable resistance circuit 12 has been described, but the constitution shown in FIG. 12B, 12C, or 3 may also be used. Moreover, the number of resistances provided in the variable resistance circuit 12 is not limited to four, and five or more or three or less resistances may also be provided.

Furthermore, as modification examples of the respective embodiments of FIGS. 13 to 15, as described in the embodiment of FIG. 8, the current mirror circuit including the NMOS transistors 15, 16 may also be provided. In the constitution in which the current mirror circuit is provided, the capacitance 17 and capacitance circuit 18 are connected to the node of the source of the NMOS transistor 15 and the node of Va.

Figure 16:
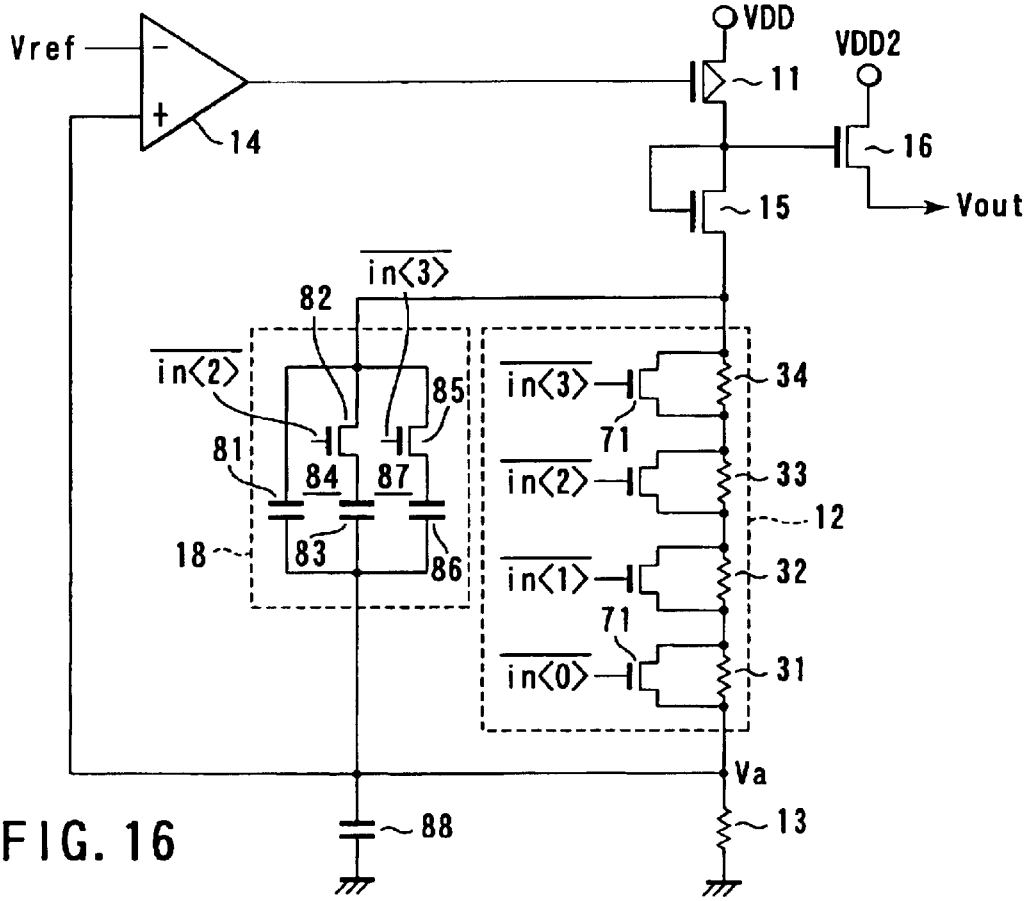
FIG. 16 shows a circuit diagram of the power supply circuit according to a modification example of the fourth embodiment.
Figure 17:
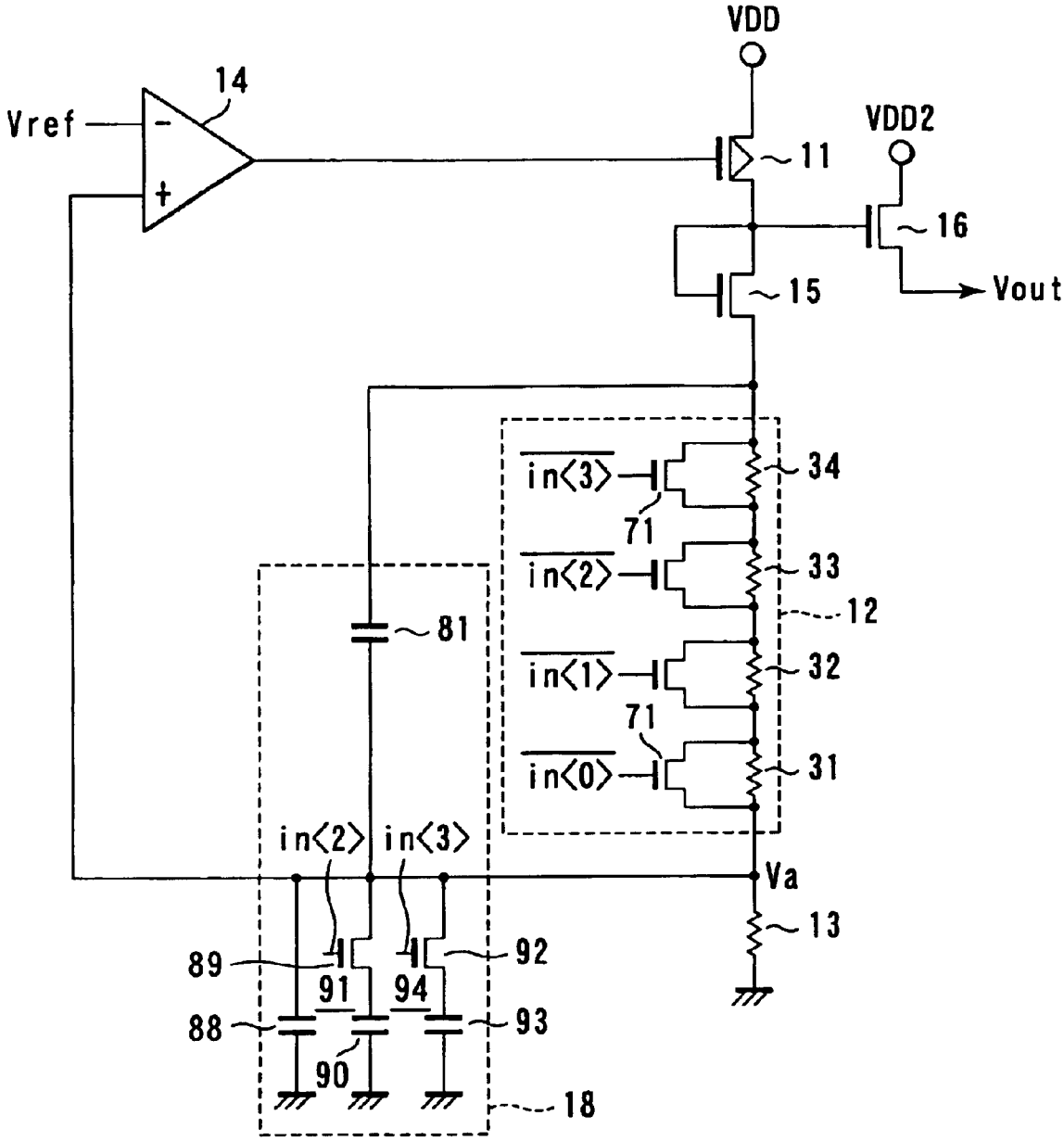
FIG. 17 shows a circuit diagram of the power supply circuit according to a modification example of the fifth embodiment.
Figure 18:
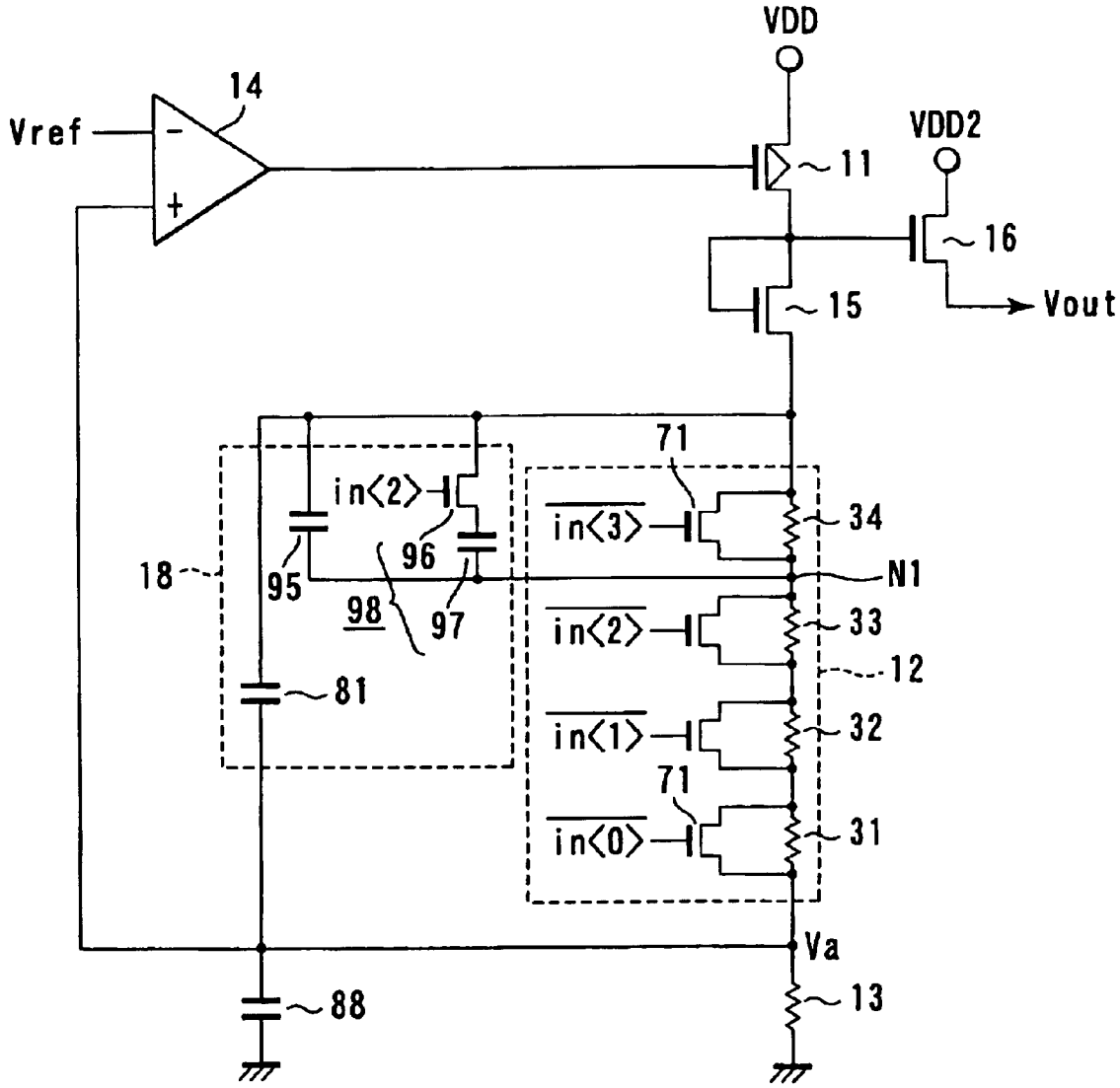
FIG. 18 shows a circuit diagram of the power supply circuit according to a modification example of the sixth embodiment.

FIGS. 16 to 18 show the power supply circuits according to the modification examples of the respective embodiments of FIGS. 13 to 15 in which the capacitance 17 and capacitance circuit 18 shown in FIGS. 13 to 15 are provided in the power supply circuit of the embodiment of FIG. 8.

In the fourth to sixth embodiments and modification examples, similarly as the power supply circuits of the first to third embodiments, the effects that the chip area can be reduced, the power supply circuit is strong against the dispersion in manufacturing the device and the circuit operation can be stabilized are obtained. Additionally, effects are obtained that the potential Vout can quickly be defined at the set value immediately after the turning-on of the power supply voltage and a high-speed startup can be realized.

In the power supply circuits of the respective modification examples of FIGS. 16 to 18, the current mirror circuit is provided, and therefore the effect that the potential fluctuation of Vout can be minimized can be obtained similarly as the embodiment of FIG. 8.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A power supply circuit comprising:

a transistor which includes a current path including one end and the other end, and a gate, said one end of said current path being connected to a supply node of a first voltage and said other end of said current path being connected to a voltage output node;

a variable resistance circuit which includes one end, the other end, and a plurality of first resistances, said one end being connected to said voltage output node, said plurality of first resistances being selected in response to control signals, said selected first resistances being connected in series between said one end and said other end of said variable resistance circuit, and unselected first resistances being connected to a supply node of a second voltage so as to change a resistance value between said one end and other end;

a second resistance connected between said other end of said variable resistance circuit and said supply node of said second voltage; and a comparison circuit which compares a voltage of said other end of said variable resistance circuit with a reference voltage and which feeds a signal indicating a comparison result back to said gate of said transistor.

2. The power supply circuit according to claim 1, wherein said plurality of first resistances have resistance values which are different from one another.

3. The power supply circuit according to claim 2, wherein said plurality of first resistances have resistance values which are $2^i$ (i=1, 2, 3, . . . ) times a certain reference value.

4. The power supply circuit according to claim 3, wherein one of said plurality of first resistances having a smallest resistance value among said plurality of first resistances being provided to be closest to said supply node of said second voltage, and said plurality of first resistances being provided so that said resistance value successively increases apart from said supply node of said second voltage.

5. The power supply circuit according to claim 1, wherein said variable resistance circuit further includes a plurality of switches, each of said plurality of switches has a current path, said current path being connected in parallel with a corresponding one of said plurality of first resistances, said plurality of switches being controlled in response to said control signals.

6. The power supply circuit according to claim 1, wherein a sum of resistance values of said plurality of first resistances is at least 1 MΩ or more.

7. The power supply circuit according to claim 1, wherein said plurality of first resistances and said second resistance include resistances each formed of a diffusion layer.

8. The power supply circuit according to claim 1, wherein said transistor is a PMOS transistor.

9. The power supply circuit according to claim 1, further comprising a capacitance connected between said voltage output node and said other end of said variable resistance circuit.

10. The power supply circuit according to claim 1, further comprising a capacitance circuit connected to said voltage output node and variable resistance circuit, a capacitance value of said capacitance circuit being controlled in response to said control signals.

11. The power supply circuit according to claim 10, wherein said capacitance circuit includes:

a first capacitance connected between said voltage output node and said other end of said variable resistance circuit; and at least one series circuit connected between said voltage output node and said other end of said variable resistance circuit, said at least one series circuit includes a switch and a second capacitance which are connected in series.

12. The power supply circuit according to claim 10, wherein said capacitance circuit includes:

a first capacitance connected between said voltage output node and said other end of said variable resistance circuit; and at least one series circuit connected between said other end of said variable resistance circuit and said supply node of said second voltage, said at least one series circuit includes a switch and a second capacitance which are connected in series.

13. The power supply circuit according to claim 10, wherein said capacitance circuit includes:

a first capacitance connected between said voltage output node and said other end of said variable resistance circuit; and a series circuit connected between said voltage output node and an intermediate node of said variable resistance circuit, said series circuit includes a switch and a second capacitance which are connected in series.

14. The power supply circuit according to claim 1, wherein said variable resistance circuit includes:

a plurality of switch circuits each of which includes first to fourth input/output terminals and a control input terminal, each of which has a function of short-circuiting between said first and second input/output terminals and between said third and fourth input/output terminals when a logic level of a signal inputted into said control input terminal is a first level, and short-circuiting between said first and third input/output terminals and between said second and fourth input/output terminals when the logic level of said signal inputted into said control input terminal is a second level and in which said third and fourth input/output terminals of said plurality of switch circuits are connected in series, said third input/output terminal of one of two switch circuits positioned in opposite ends and said fourth input/output terminal of said other circuit are connected to said supply node of said second voltage, and each of said plurality of first resistances is connected between said first input/output terminal of one of two switch circuits out of said plurality of switch circuits and said second input/output terminal of said other circuit; and a decoder circuit which generates said signals to be inputted into said control input terminals of said plurality of switch circuits in response to said control signals.

15. The power supply circuit according to claim 14, wherein each of said plurality of switch circuits includes:

a first transistor which includes a current path and a gate, said current path being connected between said first and second input/output terminals, said gate being supplied with a signal with a complementary level to a level of said signal inputted into said control input terminal;

a second transistor which includes a current path and a gate, said current path being connected between said second and fourth input/output terminals, said gate being supplied with said signal inputted into said control input terminal;

a third transistor which includes a current path and a gate, said current path being connected between said fourth and third input/output terminals, said gate being supplied with said signal with said complementary level to a level of said signal inputted into said control input terminal; and a fourth transistor which includes a current path and a gate, said current path being connected between said third and first input/output terminals, said gate being supplied with said signal inputted into said control input terminal.

16. A power supply circuit comprising:

a first transistor with a first polarity, which includes a first current path including one end and the other end, and a gate, said one end of said first current path being connected to a supply node of a first voltage;

a second transistor with a second polarity, which includes a second current path including one end and the other end, and a gate, said one end of said second current path and said gate being connected to said other end of said first current path;

a variable resistance circuit which includes one end, the other end and a plurality of first resistances, said one end being connected to said other end of said second current path, said plurality of first resistances being selected in response to control signals, said selected first resistances being connected in series between said one end and said other end of said variable resistance circuit, unselected first resistances being connected to a supply node of a second voltage so as to change a resistance value between said one end and said other end of said variable resistance circuit in response to said control signals;

a second resistance connected between said other end of said variable resistance circuit and said supply node of said second voltage;

a comparison circuit which compares a voltage of said other end of said variable resistance circuit with a reference voltage and which feeds a signal indicating a comparison result back to said gate of said first transistor; and a third transistor with the second polarity, which includes a third current path and a gate, said gate of said third transistor being connected to said gate of said second transistor, said third current path being connected between a supply node of a third voltage and a voltage output node.

17. The power supply circuit according to claim 16, wherein a sum of resistance values of said plurality of first resistances is at least 1 MΩ or more.

18. The power supply circuit according to claim 16, wherein said plurality of first resistances and said second resistance include resistances each formed of a diffusion layer.

19. The power supply circuit according to claim 16, wherein said first transistor is a PMOS transistor, and each of said second and third transistors is an NMOS transistor, respectively.

20. The power supply circuit according to claim 16, wherein said plurality of first resistances have resistance values which are different from one another.

21. The power supply circuit according to claim 20, wherein said plurality of first resistances have resistance values which are $2^i$ (i=1, 2, 3, . . . ) times a certain reference value.

22. The power supply circuit according to claim 21, wherein one of said plurality of first resistances having a smallest resistance value among said plurality of first resistances is provided to be closest to said supply node of said second voltage, and said plurality of first resistances are provided so that said resistance value successively increases apart from said supply node of said second voltage.

23. The power supply circuit according to claim 16, wherein said variable resistance circuit further includes a plurality of switches, each of said plurality of switches has a current path, said current path being connected in parallel with a corresponding one of said plurality of first resistances, said plurality of switches being controlled in response to said control signals.

24. The power supply circuit according to claim 16, wherein said variable resistance circuit includes:

a plurality of switch circuits each of which includes first to fourth input/output terminals and a control input terminal, each of which has a function of short-circuiting between said first and second input/output terminals and between said third and fourth input/output terminals when a logic level of a signal inputted into said control input terminal is a first level, and short-circuiting between said first and third input/output terminals and between said second and fourth input/output terminals when the logic level of said signal inputted into said control input terminal is a second level and in which said third and fourth input/output terminals of said plurality of switch circuits are connected in series, said third input/output terminal of one of two switch circuits positioned in opposite ends and said fourth input/output terminal of said other circuit are connected to said supply node of said second voltage, and each of said plurality of first resistances is connected between said first input/output terminal of one of two switch circuits out of said plurality of switch circuits and said second input/output terminal of said other circuit; and a decoder circuit which generates said signals to be inputted into said control input terminals of said plurality of switch circuits in response to said control signals.

25. The power supply circuit according to claim 24, wherein each of said plurality of switch circuits includes:

a fourth transistor which includes a current path and a gate, said current path being connected between said first and second input/output terminals, said gate being supplied with a signal with a complementary level to a level of said signal inputted into said control input terminal;

a fifth transistor which includes a current path and a gate, said current path being connected between said second and fourth input/output terminals, said gate being supplied with said signal inputted into said control input terminal;

a sixth transistor which includes a current path and a gate, said current path being connected between said fourth and third input/output terminals, said gate being supplied with said signal with said complementary level to a level of said signal inputted into said control input terminal; and a seventh transistor which includes a current path and a gate, said current path being connected between said third and first input/output terminals, said gate being supplied with a signal inputted into said control input terminal.

26. The power supply circuit according to claim 16, further comprising a capacitance connected between said other end of said second current path and said other end of said variable resistance circuit.

27. The power supply circuit according to claim 16, further comprising a capacitance circuit connected to said other end of said second current path and said other end of said variable resistance circuit, a capacitance value of said capacitance circuit being controlled in response to said control signals.

28. The power supply circuit according to claim 27, wherein said capacitance value of said capacitance circuit being controlled in accordance with a voltage outputted from said second current path.

29. The power supply circuit according to claim 28, wherein said capacitance circuit includes:

a first capacitance connected between said second current path and said other end of said variable resistance circuit; and at least one series circuit connected between said second current path and said other end of said variable resistance circuit, said at least one series circuit includes a switch and a second capacitance which are connected in series.

30. The power supply circuit according to claim 28, wherein said capacitance circuit includes:

a first capacitance connected between said second current path and said other end of said variable resistance circuit; and at least one series circuit connected between said other end of said variable resistance circuit and said supply node of said second voltage, said at least one series circuit includes a switch and a second capacitance which are connected in series.

31. The power supply circuit according to claim 28, wherein said capacitance circuit includes:

a first capacitance connected between said second current path and said other end of said variable resistance circuit; and a series circuit connected between said second current path and an intermediate node of said variable resistance circuit, said series circuit includes a switch and a second capacitance which are connected in series.

* * * * *